US008161692B2

(12) United States Patent
Lin

(10) Patent No.: US 8,161,692 B2
(45) Date of Patent: Apr. 24, 2012

(54) ROOF EDGE VORTEX SUPPRESSOR

(75) Inventor: Jason JianXiong Lin, Cary, NC (US)

(73) Assignee: Renscience IP Holdings, Inc., Raleigh, NC (US)

( * ) Notice: Subject to any disclaimer, the term of this patent is extended or adjusted under 35 U.S.C. 154(b) by 0 days.

(21) Appl. No.: 12/974,746

(22) Filed: Dec. 21, 2010

(65) Prior Publication Data

US 2011/0083378 A1 Apr. 14, 2011

Related U.S. Application Data

(62) Division of application No. 11/236,394, filed on Sep. 24, 2005, now Pat. No. 7,866,095.

(60) Provisional application No. 60/613,354, filed on Sep. 27, 2004.

(51) Int. Cl.
*B61D 17/02* (2006.01)
*E04D 15/00* (2006.01)

(52) U.S. Cl. ..... 52/84; 52/97; 52/741.3; 52/58; 52/94

(58) Field of Classification Search ..... 52/24, 57, 52/58, 60, 62, 84, 94, 95, 97, 101, 300, 741.3; 244/129.1, 199.1, 199.4, 200.1; 256/11, 256/12

See application file for complete search history.

(56) References Cited

U.S. PATENT DOCUMENTS

| | | | | | |
|---|---|---|---|---|---|
| 168,446 | A | * | 10/1875 | Blodget | 52/101 |
| 191,603 | A | * | 6/1877 | Lauckhardt | 256/11 |
| 224,520 | A | | 2/1880 | Dougherty | |
| 262,125 | A | * | 8/1882 | Rogers | 52/57 |
| 338,917 | A | * | 3/1886 | Bloomer | 256/11 |
| 390,061 | A | | 9/1888 | Bower | |
| 417,270 | A | | 12/1889 | Nelson | |
| 431,463 | A | | 7/1890 | Hewitt | |
| 440,104 | A | * | 11/1890 | Gaylord | 52/57 |
| 464,036 | A | * | 12/1891 | Nelson | 52/57 |
| D22,832 | S | | 10/1893 | Bryant | |
| 507,776 | A | | 10/1893 | Berger et al. | |
| 511,701 | A | * | 12/1893 | Jacobs | 256/12 |
| 595,295 | A | * | 12/1897 | Fox et al. | 52/24 |
| 633,622 | A | | 9/1899 | Souther | |

(Continued)

FOREIGN PATENT DOCUMENTS

CH 620961 A5 * 12/1980

(Continued)

OTHER PUBLICATIONS

Taher, Rima; Design of Low-Rise Buildings for Extreme Wind Events; Journal of Architectural Engineering, Mar. 2007, pp. 54-62.

(Continued)

*Primary Examiner* — Robert Canfield
*Assistant Examiner* — Charissa Ahmad
(74) *Attorney, Agent, or Firm* — Finnegan, Henderson, Farabow, Garrett & Dunner, LLP

(57) ABSTRACT

An apparatus attached to the roof perimeter to mitigate wind-generated vortices and uplift loads on the roof perimeter area of a building, applicable for both new constructions and retrofits of existing buildings. The apparatus comprises at least one face portion having face perforation and/or edge serration for increasing small-scale turbulence entrainment, equalizing pressure and disorganizing edge shear layer vorticity, and thus disrupting vortex formation. A roof edge vortex suppressor is preferably mounted along the entire circumference of a roof perimeter.

25 Claims, 4 Drawing Sheets

U.S. PATENT DOCUMENTS

| | | | | | |
|---|---|---|---|---|---|
| 701,376 | A | | 6/1902 | Noel | |
| 706,684 | A | | 8/1902 | Peter | |
| 849,984 | A | * | 4/1907 | Dougherty | 52/192 |
| 934,329 | A | * | 9/1909 | Martin et al. | 52/57 |
| 952,549 | A | * | 3/1910 | Taylor | 52/62 |
| 974,722 | A | | 11/1910 | Swanson | |
| 1,085,474 | A | | 1/1914 | Peterson | |
| 1,576,656 | A | | 3/1926 | Honsinger | |
| 1,863,561 | A | * | 6/1932 | Brinker et al. | 52/24 |
| 1,878,126 | A | | 9/1932 | Gates | |
| 2,021,929 | A | | 11/1935 | Voigt | |
| 2,206,040 | A | | 7/1940 | Ludington | |
| 2,258,803 | A | * | 10/1941 | Peles | 52/101 |
| 2,270,537 | A | | 1/1942 | Ludington | |
| 2,270,538 | A | | 1/1942 | Ludington | |
| 2,304,593 | A | * | 12/1942 | Peles | 52/101 |
| 2,306,080 | A | | 12/1942 | Julius | |
| 2,621,617 | A | * | 12/1952 | Piatt | 52/94 |
| 2,905,114 | A | | 9/1959 | Olson | |
| 2,938,243 | A | * | 5/1960 | Peles | 52/101 |
| 2,968,128 | A | | 1/1961 | Pelican | |
| 3,133,321 | A | | 5/1964 | Hine | |
| 3,280,524 | A | | 10/1966 | Hull | |
| 3,282,000 | A | * | 11/1966 | Shaw et al. | 52/101 |
| 3,289,361 | A | * | 12/1966 | Holliday | 52/24 |
| 3,583,113 | A | | 6/1971 | Winski | |
| 3,717,968 | A | | 2/1973 | Olsen et al. | |
| 3,742,668 | A | | 7/1973 | Oliver | |
| 3,969,850 | A | | 7/1976 | Hirai | |
| 4,005,557 | A | | 2/1977 | Kramer et al. | |
| 4,193,583 | A | * | 3/1980 | Witt | 256/11 |
| 4,233,786 | A | | 11/1980 | Hildreth | |
| 4,269,008 | A | * | 5/1981 | Assouline | 52/101 |
| 4,461,129 | A | | 7/1984 | von Platen | |
| 4,665,667 | A | | 5/1987 | Taylor et al. | |
| 4,830,315 | A | | 5/1989 | Presz et al. | |
| 4,832,316 | A | * | 5/1989 | Mincher | 256/11 |
| 4,957,037 | A | | 9/1990 | Tubbesing et al. | |
| 5,167,099 | A | * | 12/1992 | Nelson | 52/101 |
| 5,272,846 | A | | 12/1993 | Kelley et al. | |
| D343,014 | S | * | 1/1994 | Covini | D25/136 |
| 5,321,921 | A | | 6/1994 | Holt | |
| 5,414,965 | A | | 5/1995 | Kelley et al. | |
| D361,138 | S | | 8/1995 | Moore et al. | |
| 5,522,185 | A | | 6/1996 | Cline | |
| 5,724,776 | A | * | 3/1998 | Meadows, Jr. | 52/94 |
| 5,735,035 | A | | 4/1998 | Holt | |
| 5,813,179 | A | | 9/1998 | Koenig, Jr. et al. | |
| 5,918,423 | A | | 7/1999 | Ponder | |
| 6,044,601 | A | | 4/2000 | Chmela et al. | |
| 6,128,865 | A | | 10/2000 | Din | |
| 6,202,372 | B1 | | 3/2001 | Powell | |
| 6,212,836 | B1 | | 4/2001 | Larson | |
| 6,256,934 | B1 | * | 7/2001 | Alley | 52/25 |
| 6,283,064 | B1 | * | 9/2001 | Djukastein et al. | 119/713 |
| 6,298,608 | B1 | | 10/2001 | Alley | |
| D451,204 | S | | 11/2001 | Schlichting et al. | |
| 6,314,685 | B1 | | 11/2001 | Sullivan | |
| 6,318,028 | B2 | * | 11/2001 | Alley | 52/25 |
| 6,357,184 | B1 | * | 3/2002 | Alley | 52/25 |
| 6,360,504 | B1 | | 3/2002 | Webb et al. | |
| 6,453,623 | B1 | * | 9/2002 | Nelson et al. | 52/24 |
| 6,539,675 | B1 | | 4/2003 | Gile | |
| 6,601,348 | B2 | | 8/2003 | Banks et al. | |
| 6,606,828 | B1 | | 8/2003 | Lin et al. | |
| 6,607,168 | B1 | | 8/2003 | Cordier et al. | |
| 6,786,015 | B2 | | 9/2004 | Wilt | |
| 6,877,282 | B2 | | 4/2005 | Melsen et al. | |
| 6,928,768 | B1 | * | 8/2005 | Snow | 43/98 |
| 6,941,706 | B2 | | 9/2005 | Austin et al. | |
| 7,020,995 | B1 | * | 4/2006 | Snow | 43/98 |
| 7,137,224 | B2 | | 11/2006 | Rasmussen et al. | |
| 7,174,677 | B1 | | 2/2007 | Dressler | |
| D544,612 | S | | 6/2007 | Cochrane | |
| 7,451,571 | B2 | | 11/2008 | Allen | |
| 7,451,572 | B1 | | 11/2008 | Inzeo et al. | |
| 7,487,618 | B2 | | 2/2009 | Lin | |
| 7,823,335 | B2 | | 11/2010 | Lin | |
| 7,827,740 | B2 | | 11/2010 | Lin | |
| 7,836,642 | B2 | | 11/2010 | Lin | |
| 2001/0027625 | A1 | | 10/2001 | Webb | |
| 2002/0050104 | A1 | | 5/2002 | Reeves et al. | |
| 2002/0073633 | A1 | | 6/2002 | Schlichting et al. | |
| 2002/0083666 | A1 | | 7/2002 | Webb et al. | |
| 2002/0124485 | A1 | | 9/2002 | Pulte | |
| 2003/0005649 | A1 | | 1/2003 | Austin | |
| 2005/0210759 | A1 | | 9/2005 | Austin et al. | |
| 2006/0016130 | A1 | | 1/2006 | Lin | |
| 2006/0248810 | A1 | | 11/2006 | Ewing | |
| 2007/0113489 | A1 | | 5/2007 | Kaiser et al. | |
| 2008/0005985 | A1 | | 1/2008 | Lin | |

FOREIGN PATENT DOCUMENTS

| | | | | |
|---|---|---|---|---|
| DE | 4006864 | C1 | * | 10/1991 |
| DE | 198 48 263 | | | 5/1999 |
| JP | 2-49805 | | | 2/1990 |
| JP | 5-133141 | | | 5/1993 |
| JP | 6-185243 | | | 7/1994 |
| JP | 6-185244 | | | 7/1994 |
| JP | 06200589 | A | * | 7/1994 |
| JP | 6-288019 | | | 10/1994 |
| JP | 6-288050 | | | 10/1994 |
| JP | 6-288120 | | | 10/1994 |
| JP | 6-307122 | | | 11/1994 |
| JP | 6-336860 | | | 12/1994 |
| JP | 8-49448 | | | 2/1995 |
| JP | 7-158318 | | | 6/1995 |
| JP | 8-218683 | | | 8/1996 |
| JP | 11336276 | | | 12/1999 |
| JP | 2000-8326 | | | 1/2000 |
| WO | WO 8600950 | A1 | * | 2/1986 |

OTHER PUBLICATIONS

Moreau, Sophie; "Caractérisation et developpements aérodynamiques de l'éspace intermédiaire en climat tropical humide : Conception d'une architecture de confort adaptée à la contrainte cyclonique." Thése de Doctorat, Univ. de Nantes/Ecole d'Architecture de Nantes (Doctoral thesis, Nantes Univ./School of Architecture of Nantes, France) (1999) pp. 1-294.

U.S. Appl. No. 12/320,867 (filed Feb. 6, 2009): specification and abstract (11 pages), drawings (4 pages), and Preliminary Amendment filed Feb. 6, 2009 (11 pages); Office Action dated Nov. 11, 2009 (18 pages); Reply filed Apr. 12, 2010 (19 pages).

U.S. Appl. No. 11/187,100, filed Jul. 23, 2005: Specification, Claims, Drawings, Preliminary Amendment, Abstract; Requirement for Restriction/Election dated Feb. 6, 2008; Response to Election dated Apr. 7, 2008; non-final Office Action dated May 13, 2008 (13 pages), Interview Summary dated Jul. 29, 2008 (2 pages); Amendment filed Aug. 8, 2008 (22 pages), Response to Final Office Action filed May 8, 2009 (24 pages); Office Action mailed Dec. 8, 2008 (17 pages); Final Office Action dated May 12, 2010 (14 pages); Response filed Jan. 20, 2010 (36 pages).

U.S. Appl. No. 11/098,330, filed Apr. 4, 2005: Specification, Drawings, Preliminary Amendment, Abstract, Claims, Examiner's search strategy and results, Search Information including classification, databases and other search related notes, Bibliographic Data Sheet; Office Action (Sep. 18, 2007); Amendment (Mar. 18, 2008); Final Rejection (Jun. 11, 2008); Amendment After Final (Aug. 29, 2008); Supplemental Notice of Allowability mailed Oct. 17, 2008 and Notice of Allowability mailed on Sep. 29, 2008 (12 pages).

U.S. Appl. No. 11/286,855, filed Nov. 26, 2005: Preliminary Amendment, Drawings, Abstract, Claims. Specification, Examiner's Search Strategy and Results, Search Information including classification, databases and other search related notes, Office Action dated Oct. 12, 2007; Amendment dated Apr. 17, 2008; Final Office Action dated Sep. 16, 2008 (9 pages); Interview Summary dated Dec. 22, 2008 (2 pages); non-final Office Action dated Apr. 1, 2009 (4 pages); Response to Office Action and Amendment filed Apr. 30, 2009 (14 pages); Office Action dated Jul. 6, 2009; Office Action dated Jul. 6, 2009; Response filed Jan. 5, 2010; Office Action dated Mar. 12, 2010; Amendment filed May 19, 2010; Interview Summary dated May 24, 2010; Notice of Allowance dated Jun. 24, 2010.

Surry et al., The Effect of Surroundings and Roof Corner Geometric Modifications on Roof Pressures on Low-rise Buildings, Journal of Wind Engineering & Industrial Aerodynamics, Apr. 27, 1995, p. 113-138, vol. 58.

Lin et al., Supressing Extreme Suction on Low Buildings by Modifying the Roof Corner Geometry, Conf. Proc. vol. I, The 7th U.S. National Conf. on Wind Engineering, Jun. 27, 1993, p. 413-422, UCLA, Los Angeles, USA.

Lin et al., Aerodynamic Devices for Mitigation of Wind Damage Risk, Advances in Wind and Structures, Jeju, Korea, May 29-31, 2008.

* cited by examiner

ROOF EDGE VORTEX SUPPRESSOR

CROSS-REFERENCE TO RELATED APPLICATIONS

This application is a divisional of U.S. application No. 11/236,394, filed Sep. 24, 2005 (now U.S. Patent No. 7,866,095), which claims the benefit of U.S. Provisional Application No. 60/613,354, filed Sept. 27, 2004. The disclosure of prior U.S. application Ser. No. 11/236,394 is incorporated herein by reference.

SEQUENCE LISTING

Non-Applicable.

BACKGROUND

1. Field of Invention

This invention relates to an aerodynamic means that mitigate wind generated vortices and uplift loads on the roof perimeter area of a building, in a simple, effective, and economical way, applicable for both new constructions and retrofits of existing buildings.

2. Discussion of Prior Art

Current roof construction practices normally result in a roof perimeter configuration that tends to generate strong edge vortex and subjects the roof perimeter area to severe uplift and high risk of wind damage. Structural methods have been traditionally used to counter the severe uplift force and mitigate the risk of wind damage, while few aerodynamic methods have been recommended to reduce the uplift force. Banks et. al. described in U.S. Pat. No. 6,601,348 (2003) various types of wind spoilers supported above the roof plane to mitigate roof edge vortex. However, the apparatus is rather complicated in shape and structure, and is susceptible to wind damage itself because the raised structure subjects itself to accelerated airflow across the roof edge. In U.S. Pat. No. 4,005,557 (1977), Kramer et. al. described designs for a roof wind spoiler system claimed to be used near roof corners. The limited breadth of the apparatus impedes its effectiveness and causes higher wind loads on the adjacent segments of a roof perimeter where the apparatus does not extend. Ponder disclosed in U.S. Pat. No. 5,918,423 (1999) a wind spoiler ridge cap that is designed for roof ridges. The roof edge structure disclosed herein utilizes edge serration and face perforation to disrupt vortex formation, and is continuous along a roof perimeter or at least substantially extends from the roof corners towards the middle part of a roof edge. While the examples illustrated in this application are primarily for flat roofs, the conception and spirit herein demonstrated is suitable for both sloped and flat roofs. U.S. Pat. No. 5,414,965 (1995) of Kelley et. al. includes a drain-through gravel stop with limited face perforation for rainwater drainage, but the porosity is far from sufficient for airflow, and it does not provide edge serration, to effectively suppress roof edge vortex.

In U.S. Pat. No. 6,606,828 (2003) of this applicant et al., a series of roof edge configurations are recommended for use to mitigate vortex and high uplift in flat-roof perimeter areas, where the concept is one of coordinated exterior curvature design for a roof edge system. The present invention discloses a distinct roof edge apparatus that utilizes roof perimeter plates having face perforation and/or edge serration, which disrupt and mitigate roof edge vortices and thus reduce uplift force and wind scouring on a roof.

SUMMARY OF THE INVENTION

This invention discloses an aerodynamic means that mitigate wind generated vortices and uplift loads on the roof perimeter area of a building, in a simple, effective, and economical way, applicable for both new constructions and retrofits of existing buildings. This is achieved by using an elongated plate-like device generally having face perforation and/or edge serration and being appropriately mounted along roof perimeters. The face perforation provides air permeability facilitating a pressure equalization effect while the edge serration provides a non-straight, zigzag, edge shape leading to a flow-disorganizing effect, each of which increases small-scale turbulence entrainment, prevents or interrupts the vortex from formation along a roof perimeter. Such a roof edge device is generally referred to as roof edge vortex suppressor in this application. The specific configurations exemplified herein pertinent to this invention are primarily for perimeters of flat or low-slope roofs, while the spirit and principles of the present invention are applicable for both sloped and flat roofs. It is prudent that modifications be made according to the demonstrated concepts and principles when other types of roofs or roof edge constructions are encountered.

OBJECTS AND ADVANTAGES

Several Objects and Advantages of the Present Invention are:

- to provide roof edge devices which suppress edge vortex formation and reduce wind loads on roofing materials, roof decks and framing in the roof perimeter areas;
- to provide roof edge devices which reduce wind uplift loads generally on a building structure that are transferred from the roof;
- to provide roof edge devices which reduce vortex scouring of roof ballast materials, such as gravel and paver etc, and prevent them from becoming wind-borne missiles endangering human lives and damaging adjacent building envelopes during high wind events;
- to provide roof edge devices which stabilize wind flow over the roof and minimize cyclic loads on roof components resulting from recurring winds, reducing the chances of damage due to material fatigue;
- to provide roof edge devices which possess the desired aerodynamic performance while maintaining an aesthetic, waterproofing and draining functionality under both extreme and recurring weather conditions.

Further objects or advantages are to provide roof edge devices which protect a roof perimeter from wind and rain damage, and which are still among the simplest, most effective and reliable, and inexpensive to manufacture and convenient to install. These and still further objects and advantages will become apparent from a consideration of the ensuing description and drawings.

DESCRIPTION OF THE PREFERRED EMBODIMENTS

Figure 1:
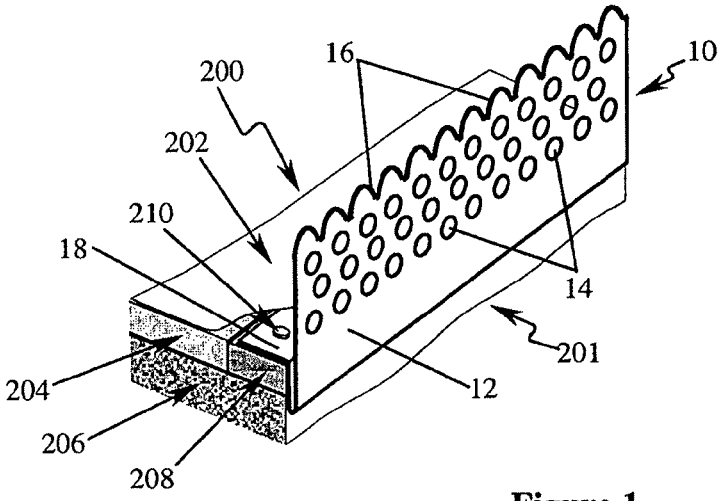
FIG. 1 schematically illustrates the isometric view of one of the basic configurations, as being installed on the perimeter of a flat roof as an example.

FIG. 1 illustrates a preferred embodiment of this invention, where the isometric view of a segment of a vortex suppressor as installed on a typical flat roof is depicted. A roof edge vortex suppressor is generally an elongated apparatus 10 disposed longitudinally in parallel with, and attached to, a roof edge, and is preferably mounted along the entire circumference of a roof perimeter. A face portion 12 with perforations 14 and upper edge serration 16 extends upwardly substantially above the roof plane 200. The vortex suppressor 10 shall be made of sufficiently stiff material, such as, sheet metal. In this particular example, the plane of the face portion 12 is perpendicular to the roof plane 200; however, configurations with the two planes forming an oblique angle are also allowable, for example, by bending the face portion 12 outwardly or inwardly at the intersection of the two planes. Deep serration on the upper edge and substantial perforation on the face are generally preferred, in order to augment the functionality of roof edge vortex suppression. A serrated or zigzag edge, instead of a straight edge, eliminates, a condition that favors the formation of an organized vortex under various wind directions. In other words, edge serration disorganizes the flow shear layer over an edge and prevents vorticity embedded in the shear layer from forming a concentrated vortex over the roof edge zone. On the other hand, a sufficiently perforated face allows for air permeability and pressure equalization between the two regions across the roof edge, suppressing the forcing mechanism for vortex formation. Face perforation and edge serration also cause small-scale turbulence entrainment and dissipation of kinetic airflow energy that further enhance the effect of edge vortex suppressor. Thus the function of face perforation and edge serration is to disrupt the formation of the roof edge vortex that would otherwise cause severe uplift loads and wind scouring on the roof surface.

The specific layout, number, shapes and sizes of the distributed perforation-holes are not of primary significance, as long as the overall porosity resulting from the face perforation is sufficiently large to provide desired air-permeability. Similarly, while deeper serration or indentation are generally preferred by using larger sizes for the projections and notches of the zigzag edge, their specific layout, number and shapes are not of critical significance. Triangular, rectangular, trapezoidal, semi-circular and semi-elliptic shapes etc., for example, are all permissible without compromising the functionality described herein. It is also allowable that the perforations, projections and notches have different shapes and sizes in the same vortex suppressor assembly. The choices may be made in combination with aesthetic considerations.

A roof edge vortex suppressor may be mounted on and secured to a roof edge with any appropriate means that does not negatively affect its functionality. In this example, the vortex suppressor 10 extends downwardly in parallel with wall surface 201, and bends back upwardly and then inwardly to conform to the wall surface 201 and roof plane 200, forming a mounting base 18 for the device being secured to the roof perimeter with fasteners 210. The method to mount and secure the vortex-suppressing device to the roof perimeter as illustrated herein is merely an example, with many alternative common methods being possible, and ought not to limit the scope of this invention. Roof membrane 202, insulation material 204, substrate 206 and wood nailer 208, being examples of common roof components, are included in the drawings herein merely to illustrate their relationships with the vortex suppressor that is the subject matter of this invention.

Figure 2:
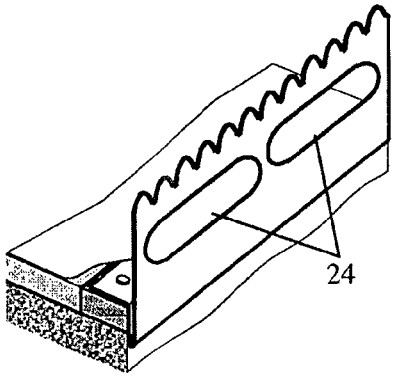
FIGS. 2 and 3 show example variations of face perforation and edge serration of the vortex suppressor.
Figure 3:
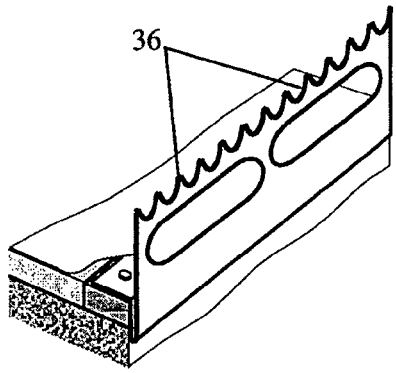

FIGS. 2 and 3 illustrate two examples of allowable variations, for which larger openings 24 as a form of perforation and/or alternative sawtooth-like edge geometry 36 are utilized, respectively. Again, the specific shapes of geometric elements and their spatial arrangement for edge serration and face perforation illustrated are merely examples to help showcase the spirit and principles of this invention, and many other shapes and arrangement patterns are possible in accordance with the spirit demonstrated herein.

Figure 4:
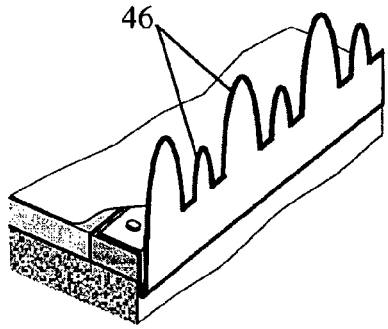
FIGS. 4 through 6 are isometric views showing examples of another family of edge serration and/or face perforation.
Figure 5:
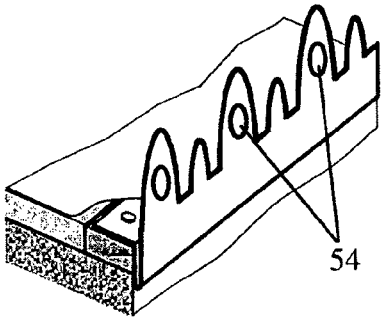
Figure 6:
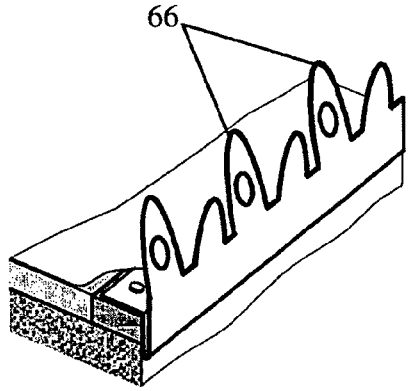

Utilization of both edge serration and face perforation is generally preferred; however, use of only edge serration or face perforation is also allowable. As an example, the embodiment illustrated in FIG. 4 uses only edge serration, where deep and alternate serration 46 is employed, which is particularly preferred in the absence of face perforation. Many variations are possible. For example, FIG. 5 shows an embodiment that has additional perforation 54, while FIG. 6 illustrates one for which geometric elements 66 of the edge serration alternately bend inwardly from vertical. Outward bending is also permissible. On the other hand, if using only face perforation without edge serration, then other enhancements are needed. Firstly, the perforated face portion should extend upwardly at least 6" above the roof plane, and secondly, the overall porosity of this raised portion must be at least 40%, in order to effectively suppress roof edge vortex. Furthermore, it is preferred that the raised face portion curves or bends outwards at an angle from vertical. The following alternative configurations offer further enhancements.

Figure 7:
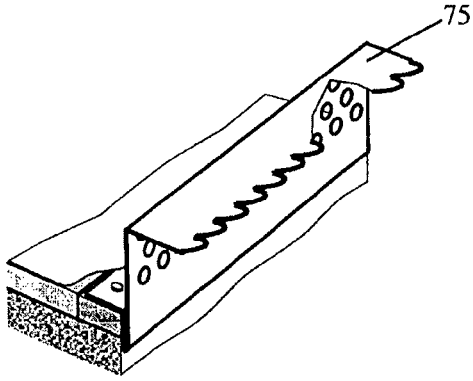
FIGS. 7 through 10 schematically illustrate alternative cross-sectional configurations for the roof edge vortex suppressor.
Figure 8:
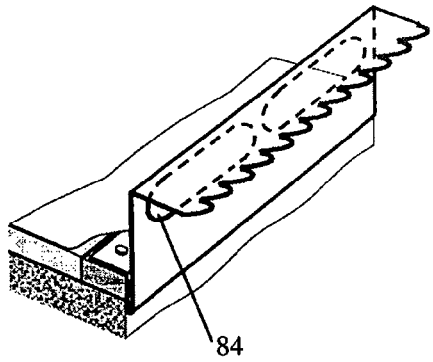
Figure 9:
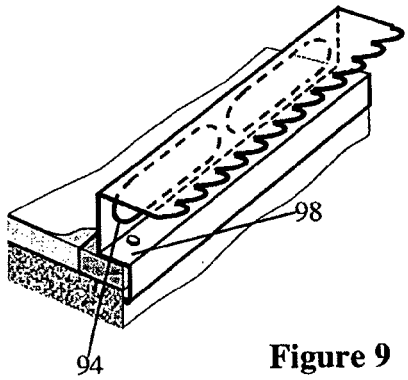
Figure 10:
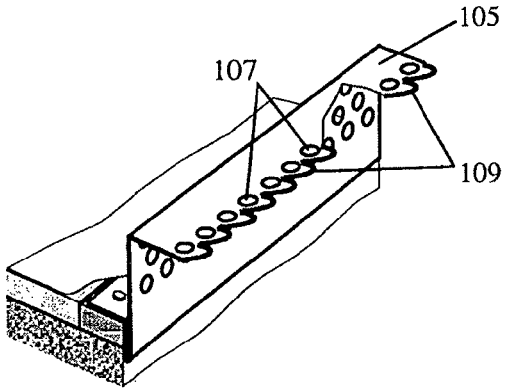

FIGS. 7 through 10 illustrate alternative embodiments of this invention that have a generally horizontal upper face portion providing a significant enhancement for vortex suppression. The horizontal upper face portion 75, as shown in FIG. 7 for example, increases the pressure beneath it and the horizontal component of the flow velocity across the perforated vertical face portion, further mitigates edge flow shear layer separation that preludes a vortex formation. FIGS. 8 and 9 show examples of permissible variations, for which larger openings 84 and 94 are utilized as a form of perforation, and an alternative mounting base 98 is also illustrated in FIG. 9. Moreover, as exemplified in FIG. 10, perforation 107 as well as edge serration 109 on the horizontal upper face portion 105 are optional but preferable for these configurations, which help reduce wind loads on the device itself and on the roof. Furthermore, it is also allowable that the sawtooth-like geometric elements on the serrated outer edge of the horizontal upper face portion bend uniformly or alternately at an angle from horizontal, and/or have various shapes and sizes along a span of the vortex suppressor.

Figure 11:
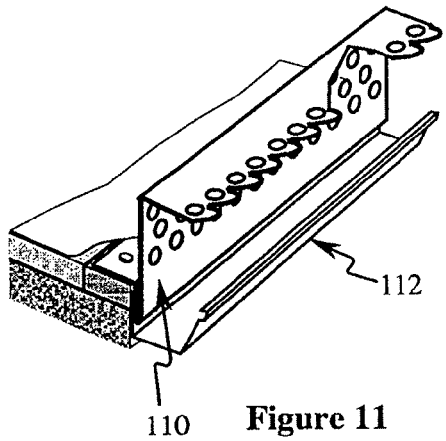
FIG. 11 exemplifies the use of a roof edge vortex suppressor with a conventional gutter.

FIG. 11 exemplifies an embodiment of this invention being used with a traditional gutter 112. In this case, the vortex suppressor 110 will also function as a drain-through gravel stop or edge fascia.

Figure 12:
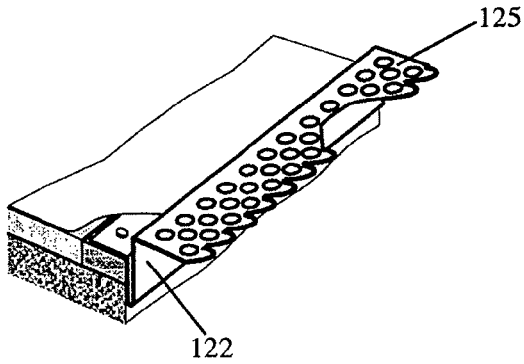
FIG. 12 illustrates further another alternative configuration of the vortex suppressor.

FIG. 12 illustrates further another embodiment of the invention, which uses face perforation and edge serration on a generally horizontal upper face portion that is disposed slightly above the roof plane. In this embodiment, the horizontal face portion 125 provides the function of vortex suppression, while the vertical portion 122 serves as gravel stop and edge fascia. It is acceptable that the perforated upper face portion forms an angle with the roof plane. It is also permissible that the sawtooth-like geometric elements on the serrated outer edge of the upper face portion bend uniformly or alternately at an angle from the plane of the upper face portion, and/or have various shapes and sizes along a span of the vortex suppressor.

A edge vortex suppressor described herein provides protection against wind and rain damage for a flat roof when the apparatus and its geometric relationship with the roof perimeter are configured in accordance with the spirit of this invention, as exemplified herein in the specification and governed in the appended claims. The examples given in this application are merely for the purpose of describing the invention and should not be construed as limiting the scope of the invention or the applicable variations of configuration according to the spirit of this invention. It is emphasized that the geometric elements for edge serration or face perforation need not to have the same shapes or a strictly regular spatial pattern as those illustrated herein. Many other shapes such as triangles, rectangles and trapezoids, arranged in various patterns, can also be used for forming serrated edges and/or perforated faces according to the spirit of the invention disclosed in this application without compromising the function of the vortex suppressor.

Installation and Operation

An embodiment of this invention is a passive flow control device for roof edges. Once configured and installed properly, it stays functioning in such a way that it mitigates vortex formation at a roof edge and reduces uplifts and wind scouring on the roof, whenever the wind blows towards a building bearing atop such roof edge devices, and requires no active operational intervention.

Conclusion, Ramifications, and Scope

It is apparent that roof edge vortex suppressors of this invention provide advantageous devices for mitigating roof edge vortex and roof uplift, and are still among the simplest, most effective and reliable, inexpensive to manufacture and convenient to install, with little, if any, maintenance requirement.

Compared to the prior art, the present invention provides a unique one-piece, self-supported, substantially simpler and stronger structure that can be conveniently fastened to the roof edge with superior stability, while at the same time ensures a key function of suppressing roof edge vortex. In addition, this present invention also provides a function of being an effective roof gravel stop and an aesthetic edge termination fascia.

Although the description above contains many specifications, these should not be construed as limiting the scope of the invention but as merely providing illustrations of some of the presently preferred embodiments of this invention. Various changes, modifications, variations can be made therein without departing from the spirit of the invention. Roof edge vortex suppressors can be made of any reasonably durable material with any appropriate means of fabrication as long as a configuration according to the spirit of this invention is accomplished to support the described working mechanism and to provide the associated functionality. Any appropriate conventional or new mounting method can be used to secure a roof edge vortex suppressor to a roof perimeter without departing from the spirit of this invention. Thus the scope of the invention should be determined by the appended claims and their legal equivalents, rather than by the examples given.

I claim:

1. An elongated device disposed along, and attached to, a perimeter of a roof, wherein the roof includes a roof component having an upper surface defining an uppermost surface of a roof assembly, the device comprising:

a generally vertical face portion extending upwardly above a plane defined by the uppermost surface of the roof assembly without being underneath any roofing material on the roof or any roof covering on the roof, wherein the generally vertical face portion includes an uppermost part defining an unattached, free end of the generally vertical face portion, wherein the uppermost part of the generally vertical face portion comprises an edge serration, and wherein the generally vertical face portion has perforations; and a mounting portion securing said elongated device to said perimeter of the roof;

wherein the elongated device extends along the perimeter of the roof at least substantially from one corner of the roof to at least a middle part of the roof perimeter.

2. The elongated device of claim 1, wherein the edge serration is defined by a plurality of serration elements, and wherein each of the serration elements has substantially the same size.

3. The elongated device of claim 1, wherein the edge serration is defined by a plurality of serration elements and wherein the serration elements comprise serration elements having sizes that differ from one another.

4. The elongated device of claim 3, wherein the serration elements comprise serration elements extending upwardly to differing heights above the plane defined by the uppermost surface of the roof assembly.

5. The elongated device of claim 3, wherein the plurality of serration elements define a row of serration elements, and wherein alternating serration elements along the row are shorter than other alternating serration elements along the row.

6. The elongated device of claim 1, wherein the edge serration is defined by a plurality of serration elements and wherein the serration elements comprise serration elements extending in directions that differ from one another.

7. The elongated device of claim 1, wherein the plurality of serration elements define a row of serration elements, and wherein alternating serration elements along the row are angled inwardly with respect to a vertical plane extending along the perimeter of the roof.

8. The elongated device of claim 1, wherein the edge serration is defined by a plurality of serration elements and wherein the plurality of serration elements comprise serration elements each having a respective top surface portion having a convex curved shape.

9. The elongated device of claim 1, wherein the edge serration is defined by a plurality of serration elements and wherein the perforations include perforations extending through portions of the serration elements.

10. The elongated device of claim 1, wherein the perforations include multiple rows of perforations extending along the length of the device.

11. The elongated device of claim 1, wherein the perforations include perforations having an elongated oval shape.

12. The elongated device of claim 1, wherein the generally vertical face portion extends upwardly at least six inches above the plane defined by the uppermost surface of the roof assembly.

13. The elongated device of claim 1, wherein the generally vertical face portion has an overall porosity of at least 40%.

14. The elongated device of claim 1, wherein the elongated device is disposed parallel to an edge of the roof.

15. The elongated device of claim 1, wherein the elongated device is disposed in contact with an edge of the roof.

16. The elongated device of claim 1, wherein the generally vertical face portion is disposed parallel to a wall surface located below the plane defined by the uppermost surface of the roof assembly.

17. An elongated device disposed along, and attached to, a perimeter of a roof, wherein the roof includes a roof component having an upper surface defining an uppermost surface of a roof assembly, the device comprising:

a generally vertical face portion extending upwardly above a plane defined by the uppermost surface of the roof assembly without being underneath any roofing material on the roof or any roof covering on the roof, wherein the generally vertical face portion includes an uppermost part defining an unattached, free end of the generally vertical face portion, wherein the uppermost part of the generally vertical face portion comprises an edge serration, and wherein the generally vertical face portion has perforations; and a mounting portion securing said elongated device to said perimeter of the roof;

wherein the elongated device extends along the perimeter of the roof continuously from one corner of the roof to another corner of the roof.

18. A method of suppressing roof edge vortex, comprising:

securing an elongated device to a perimeter of a roof, the elongated device extending along the perimeter of the roof at least substantially from one corner of the roof to at least a middle part of the roof perimeter, and including a generally vertical face portion extending upwardly above a plane defined by an uppermost surface of a roof assembly of the roof without being underneath any roofing material on the roof or any roof covering on the roof, wherein the generally vertical face portion includes an uppermost part defining an unattached, free end of the generally vertical face portion, wherein the uppermost part of the generally vertical face portion comprises an edge serration, and wherein the generally vertical face portion has perforations, and a mounting portion; and disrupting a formation of a roof edge vortex of wind coming into contact with the device.

19. The method of claim 18, wherein disrupting the formation of the roof edge vortex includes equalizing pressure across said generally vertical face portion.

20. The method of claim 18, wherein disrupting the formation of the roof edge vortex includes creating a flow-disorganizing effect with said edge serration of said generally vertical face portion.

21. The method of claim 18, wherein the securing comprises disposing the device parallel to an edge of the roof.

22. The method of claim 18, wherein the securing comprises disposing the device in contact with an edge of the roof.

23. The method of claim 18, wherein the generally vertical face portion is disposed parallel to a wall surface located below the plane defined by the uppermost surface of the roof assembly.

24. An elongated device disposed along, and attached to, a perimeter of a roof, wherein the roof includes a roof component having an upper surface defining an uppermost surface of a roof assembly, the device comprising:

a generally vertical face portion extending upwardly above a plane defined by the uppermost surface of the roof assembly without being underneath any roofing material on the roof or any roof covering on the roof, wherein the generally vertical face portion includes an uppermost part defining an unattached, free end of the generally vertical face portion, wherein the uppermost part of the generally vertical face portion comprises an edge serration, and wherein the generally vertical face portion has perforations; and a mounting portion securing said elongated device to said perimeter of the roof;

wherein a lower part of the generally vertical face portion is disposed outward beyond the roof perimeter.

25. A method of suppressing roof edge vortex, comprising:

securing an elongated device to a perimeter of a roof, the elongated device being disposed along the perimeter and including a generally vertical face portion extending upwardly above a plane defined by an uppermost surface of a roof assembly of the roof without being underneath any roofing material on the roof or any roof covering on the roof, wherein the generally vertical face portion includes an uppermost part defining an unattached, free end of the generally vertical face portion, wherein the uppermost part of the generally vertical face portion comprises an edge serration, wherein the generally vertical face portion has perforations, and wherein a lower part of the generally vertical face portion is disposed outward beyond the roof perimeter, and a mounting portion; and disrupting a formation of a roof edge vortex of wind coming into contact with the device.

* * * * *